US005402999A

United States Patent [19]

Keehn, Sr.

[11] Patent Number: 5,402,999

[45] Date of Patent: Apr. 4, 1995

[54] BASKETBALL SAFETY RETURN

[76] Inventor: Gorman E. Keehn, Sr., 1200 Primrose Ct., Bensalem, Pa. 19020

[21] Appl. No.: 155,362

[22] Filed: Nov. 22, 1993

[51] Int. Cl.[6] ..... A63B 69/00; E04H 17/00

[52] U.S. Cl. ..... 273/1.5 R; 273/410; 273/411; 160/135; 160/351; 256/45; 256/47; 472/94

[58] Field of Search ..... 273/396, 410, 411, 1.5 R, 273/1.5 A, 393 A, 25, 26 A; 472/92, 94; 160/135, 351; 256/45, 47, 66

[56] References Cited

U.S. PATENT DOCUMENTS

| | | | |
|---|---|---|---|
| 1,383,610 | 7/1921 | Doremus | 273/393 |
| 3,388,909 | 4/1967 | Woods | 273/1.5 R |
| 3,897,950 | 8/1975 | Keller | 273/411 |
| 3,901,506 | 8/1975 | Caveney | 273/1.5 A |
| 4,022,471 | 5/1977 | Keller | 273/411 |
| 4,284,277 | 8/1981 | Leonard et al. | 273/411 |
| 4,415,163 | 11/1983 | Schoenig | 273/411 |
| 4,489,941 | 12/1984 | Shieh | 273/26 A |
| 4,715,598 | 12/1987 | Knight | 272/3 |
| 4,762,319 | 8/1988 | Krumbolz | 273/1.5 R |
| 4,786,053 | 11/1988 | Barnes, Jr. | 273/1.5 R |

*Primary Examiner*—William H. Grieb
*Attorney, Agent, or Firm*—Michael F. Petock

[57] ABSTRACT

A basketball safety return apparatus utilizes a plurality of moveable pole support bases and a plurality of poles adapted to be mounted vertically in the pole support bases. Netting is connected to the vertically mounted poles and the poles and bases are mounted and arranged so that the netting forms a barrier behind the basketball hoop and along at least one side. The basketball safety return apparatus may be readily assembled, positioned, disassembled and stored. The inexpensive apparatus of the present invention prevents the basketball from rolling into the neighbor's yards and more importantly from rolling down a driveway into a street where it may be retrieved without sufficient attention to avoid a child being hit by a vehicle approaching on a street.

48 Claims, 3 Drawing Sheets

66
64
62
48
54
60
34
62
50
38
44
40
24
32
28
30

BASKETBALL SAFETY RETURN

FIELD OF THE INVENTION

The present invention relates to a basketball safety return apparatus. More particularly, the present invention relates to a basketball safety return apparatus which is relatively inexpensive and readily assembled, positioned and disassembled.

BACKGROUND OF THE INVENTION

Many residences have basketball nets mounted on or around the garage driveway for the playing of basketball. The basketball often ends up going either into a neighbor's yard or rolling down the driveway which is typically sloped downwardly from the garage to the street to enable water flow away from the garage. Either or both of these situations result in problems. Often the basketball is played by children. The children may run into the neighbor's yard to retrieve the basketball and possibly trample flowers, or other plantings. An even more serious problem is the child running into the street to retrieve the basketball and that has run down the driveway without looking as to whether any vehicles may be approaching on the street. This may result in serious injury or death to the child playing basketball. The present invention attempts to eliminate or alleviate these problems.

SUMMARY OF THE INVENTION

The present of the invention is directed to a basketball safety return apparatus which is relatively inexpensive to manufacture, may be readily assembled and positioned in place without difficulty and may be easily disassembled after the game of basketball and stored without requiring excessive space.

Briefly and basically, in accordance with the present invention, the basketball safety return apparatus includes a plurality of moveable pole support bases and a plurality of poles adapted to be mounted vertically in the pole support bases. Netting is provided which is adapted to be connected to the vertically mounted poles. The poles and bases are mounted and arranged in relation to the basketball hoop so that the netting forms a barrier behind the basketball hoop and along at least one side. Preferably, the netting is arranged so that it will catch any balls which miss the backboard of the basketball hoop and also catch any balls which tend to roll down an incline such as a driveway.

In a preferred embodiment, the poles may be comprised of two pieces of polyvinyl chloride (PVC) piping which may be readily assembled and disassembled into a vertical pipe, such as by a male/female connection. Preferably, the pole support bases are containers which are adapted to receive the lower end of the vertical poles and which may be filled with ballast. The netting is preferably large size mesh netting which reduces the weight and is less expensive to manufacture. In view of the size of the basketball, the mesh may be selected to be two inches by two inches or larger, and even a six inch by six inch mesh would work well, although the preferred size of the mesh is approximately four and one half inches.

In a preferred embodiment, a plurality of vertically mounted poles, preferably three, are mounted in moveable bases behind the baseboard. At least one additional vertical pole is mounted in a moveable base which forms an angle with the first three which is approximately in orthogonal direction. However, it is understood that by approximately orthogonal, this angle may deviate significantly from ninety degrees, and in certain applications may be arranged so that it forms an angle of as little as forty-five degrees or more than one hundred and thirty-five degrees. The large size mesh netting is connected between the poles.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
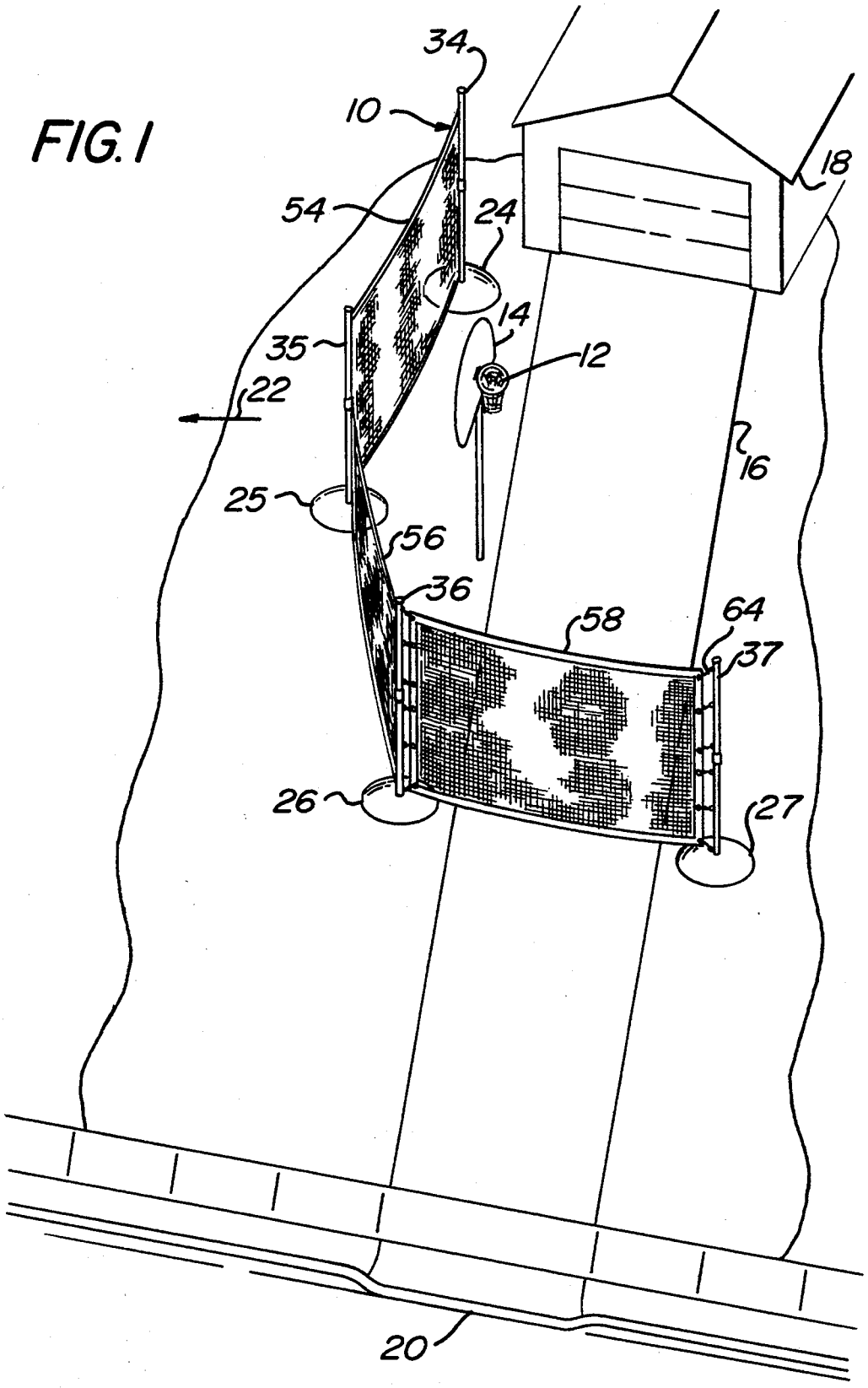
FIG. 1 is a broken away view in perspective of an embodiment of the present invention.

Referring now to the drawings wherein like numerals indicate like elements, there is shown in FIG. 1 a basketball safety return apparatus 10 in accordance with the present invention. The basketball safety return apparatus 10 is illustrated in FIG. 1 in one typical arrangement wherein a basketball hoop 12 with its backboard 14 is mounted along side a driveway 16 which leads to a garage 18. The driveway 16 typically slopes downwardly from the garage to the street 20 to enable water flow away from the garage. Typically, there may be a neighbor's yard adjacent the driveway and one illustration could be in the direction of arrow 22. However, it is understood that many variations and arrangements are possible. FIG. 1 illustrates one arrangement of the basketball safety return apparatus 10 of the present invention, but as will be described hereinafter, the safety return apparatus 10 may be arranged in various configurations.

Figure 2:
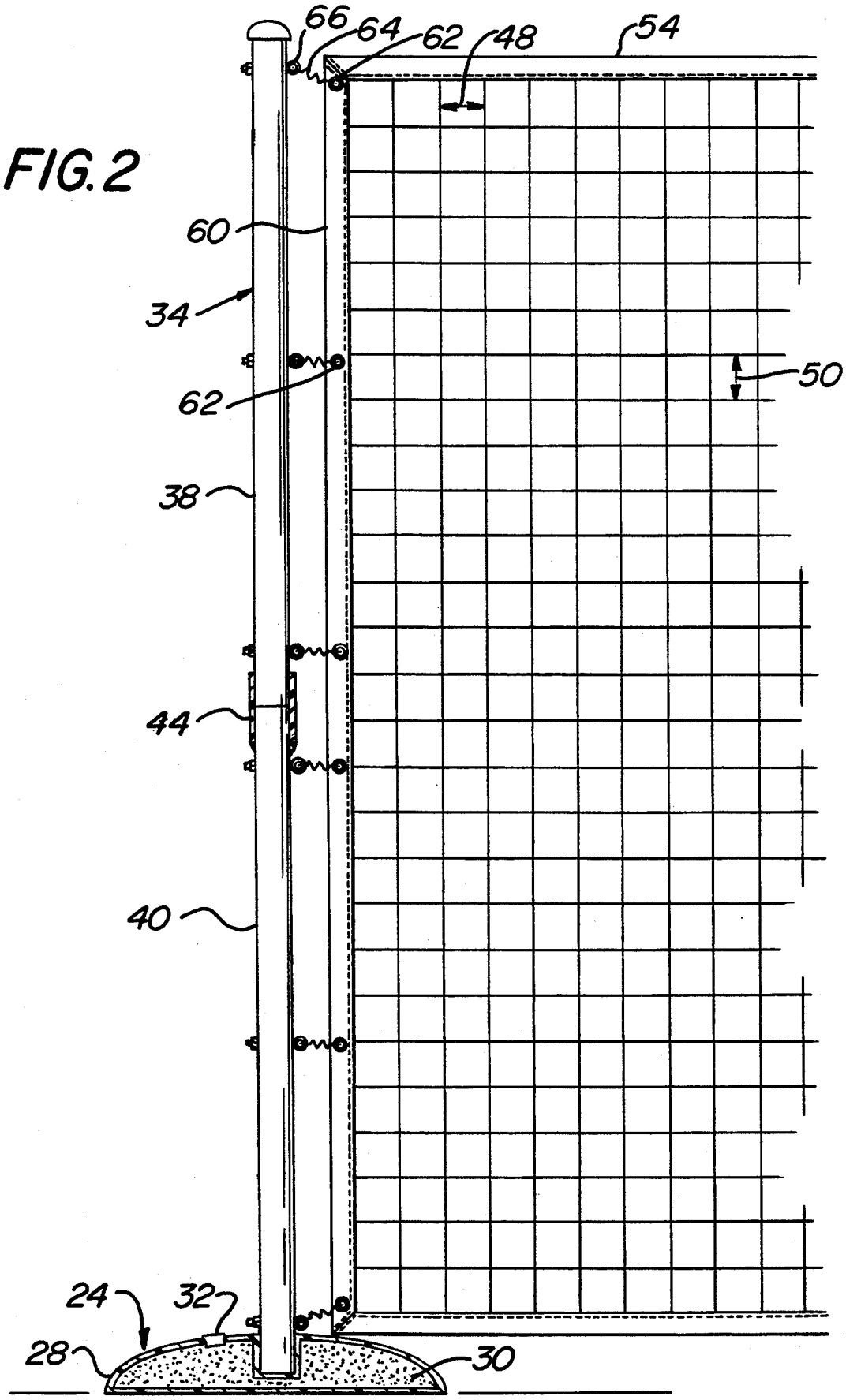
FIG. 2 is a broken away view illustrating an embodiment of a pole, supporting base and netting structure in accordance with the present invention.

The basketball safety return apparatus 10 of the present invention includes a plurality of moveable pole support bases 24, 25, 26 and 27. A cross-sectional view of base 24 is shown in FIG. 2 wherein it is illustrated that it may be comprised of a container 28 which may be filled with sand, water or other ballast material 30 through an opening 32. As may be seen from the drawings, the support bases 24 through 27 are moveable to various locations basically being held in place by the friction between the moveable base and the surface on which it rests through the force of gravity acting on the ballast filled container.

In the arrangement illustrated in FIG. 1, a first plurality of moveable support bases 24, 25 and 26 are arranged substantially in a slightly curved arrangement behind the basketball hoop 12 and backboard 14. One additional moveable base 27 may be positioned in a somewhat orthogonal direction from the first plurality of bases 24, 25 and 26 to form a stop across any incline, such as driveway 16 as more particularly described hereinafter. However, it is understood that there may be various arrangements of the moveable bases to meet the particular configuration of the basketball playing area and that substantially orthogonal generally means from an acute angle of forty-five degrees to one hundred thirty-five degrees. A plan view of a substantially orthogonal arrangement is illustrated in FIG. 3.

Figure 3:
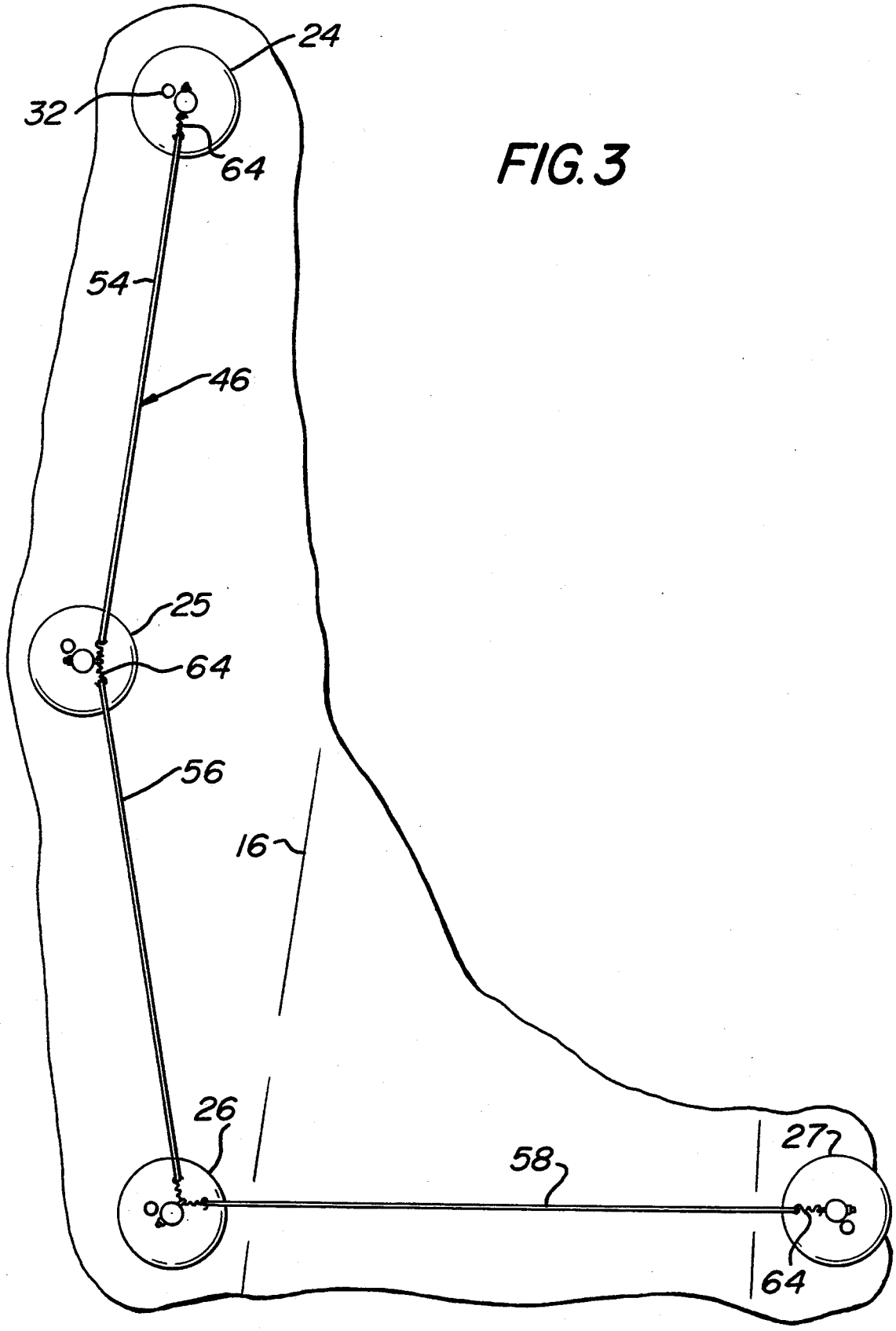
FIG. 3 is a broken away plan view of an embodiment of the present invention.

As may be seen from FIGS. 1 through 3 and particularly FIG. 2, vertical poles 34, 35, 36 and 37 are mounted, respectively, in moveable support bases 24 through 27. The lower end of the vertical poles may preferably be mounted within a recess in the bases as illustrated in FIG. 2 with respect to vertical pole 34 and base 24. However, it is understood that other suitable means of attaching the lower end of pole 34 to a moveable base is within the scope of the present invention.

The vertical poles may be unitary poles and may be comprised of any suitable fairly rigid material. However, it is presently preferred that materials such as three inch plastic piping might be utilized. In the presently preferred embodiment, it is contemplated that three inch polyvinyl chloride (PVC) pipe may be utilized to construct the vertical poles. It is presently preferred that the vertical poles, such as vertical pole 34 as illustrated in FIG. 2 may be comprised of two sections, preferably, but not necessarily, substantially equal. In a presently preferred embodiment, the overall height of poles 34 through 37 would be approximately eleven feet and each of the two sections of piping 38 and 40 making up the vertical pole would be approximately five and one half feet.

As illustrated in FIG. 2, in the presently preferred embodiment, the two sections of piping 38 and 40 may be readily connected and disconnected utilizing a male/female connection as illustrated at 44 in FIG. 2. In a presently preferred embodiment, connector 44 may be a pipe union which may be adhesively bonded to lower pipe section 40 by typical solvent base adhesive utilized to join polyvinyl chloride pipe. In such a case, the upper section of pipe 38 may be readily slid into union 44 when the basketball safety return apparatus 10 is assembled for use and may be readily slid out of union 44 when being disassembled for storage. However, it is understood that various other arrangements of joining two sections of pipe may be utilized, and in fact, it is recognized and understood that there is no real need to adhesively bond the union 44 to either section of the pipe. It is also recognized that means of joining the two sections of pipe other than a male/female connection may be utilized. As discussed above, the vertical poles may even be of a single piece.

It is further understood that more or less than four vertical poles and moveable supporting bases may be utilized in practicing the invention. However, it is presently preferred that an arrangement substantially similar to that shown may be utilized in practicing the present invention as it is believed to provide a basketball safety return which may be utilized quite effectively to prevent the basketball from leaving the playing area at a reasonable cost.

As may be seen from the drawing FIGS. 1 through 3, the vertical poles 24 through 27 are connected together by netting 46. Netting may be attached to the poles by any suitable means, and preferably, the netting is of a large mesh light weight type of netting. Since the netting is intended to stop a basketball, the mesh may be as large as six inches and is preferably larger than two inches. In a presently preferred embodiment, the dimension of the mesh would be four and one half inches, that is a square of approximately four and one half inches. As illustrated in FIG. 2, the dimension 48 is preferably four and one half inches and the dimension 50 is preferably four and one half inches. However, it is understood that the mesh of the netting need not be square and may be rectangular and that various dimensions of netting may be utilized so long as the size of the mesh is smaller than that of a basketball.

The netting 46 connecting together the vertical poles may be of various preselected dimensions. However, in the present preferred embodiment, the length of netting 54 between vertical poles 34 and 35 is preferably twelve feet long and ten and one half feet high. However, it is understood that various other dimensions of both length and height are readily usable in practicing the present invention. Even netting six feet high would significantly stop most of the errant basketballs. Similarly, the netting 56 between pole 35 and 36 may be twelve feet long and of the same height as netting 54. However, it is understood that although it is presently preferred that all of the sections of the netting be of the same height, within the spirit and scope of the present invention, the height as well as the length of different sections of netting could vary. The section of netting 58 between poles 36 and 37 is preferably fourteen feet long and preferably of the same height as the other sections of netting, but again this may vary within the scope of the present invention.

The netting sections 54, 56 and 58 may be connected to the vertical poles by any suitable means. However, in the presently preferred embodiment, as best illustrated in FIG. 2, the netting may be connected to the vertical poles by means of springs. As illustrated in FIG. 2, netting 54 is preferably provided with an edge, border or flap 60 which is provided with grommets 62. Springs 64 are utilized to connect the grommets 62 to eye-bolts 66 or other suitable fastening means on the vertical poles. As illustrated in FIGS. 1 and 2, and particularly FIG. 2, each section making up a vertical pole is preferably provided with three spring connections to the net, thereby provided six spring retaining means along each edge of the net. However, it is understood that a greater or lesser number of springs 64 may be utilized to connect each edge of the netting to a vertical pole. Further, various other means may be utilized to fasten the netting to the poles, but in the presently preferred embodiment, suitable two inch springs are presently preferred as they will provide some tension in the net both to prevent the net from sagging and also to provide a rebound effect when a basketball hits the net.

In using the basketball safety return apparatus 10 of the present invention, the apparatus may be readily stored since its component parts may be readily disassembled and reassembled. For storage, the pipe sections 38 and 40 of each pole may be readily taken apart, such as by sliding the upper section 38 out of the union 44. The netting may be readily detached from the vertical poles when taking the netting down and may be readily attached to it when putting the netting up. For storage, the netting may be folded and wrapped into compact units. The supporting bases 24 though 27 may be readily stored. For ease of movement, the bases may be emptied of their ballast, particularly if water is utilized as the ballast, since this may be emptied substantially anywhere on the ground and readily re-filled.

In assembling and utilizing the basketball safety return apparatus 10 of the present invention, it may be configured in various configurations. Preferably at least one section of it would be behind the basketball hoop and backboard and the remaining sections positioned to prevent the basketball from going in unwanted directions, such as down an incline to the street.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A basketball safety apparatus, comprising:

netting used in combination with a basketball hoop;

a plurality of moveable pole support bases said bases being adapted to be positioned in proximity to said basketball hoop and a driveway that connects to a street;

a plurality of poles adapted to be mounted vertically in said pole support bases said poles having a height approximately the height of the basketball hoop;

said netting connected to said vertically mounted poles, said netting having mesh size sufficient to stop a basketball; and said poles and bases being mounted and arranged so that said netting forms a barrier in one or more directions from said basketball hoop and across said driveway.

2. A basketball safety apparatus in accordance with claim 1, wherein each of said poles is comprised of two pieces of approximately equal length pipe wherein said pieces may be readily joined for assembly.

3. A basketball safety apparatus in accordance with claim 2, wherein said two pieces of pipe are joined by a male/female connection.

4. A basketball safety apparatus in accordance with claim 2, wherein each of said pieces of pipe are approximately five and half feet long.

5. A basketball safety apparatus in accordance with claim 1, wherein said poles are comprised of polyvinyl chloride (PVC) pipe.

6. A basketball safety apparatus in accordance with claim 1, wherein said pole support bases are comprised of containers adapted to receive one end of said pole, said containers being adapted to be filled with ballast.

7. A basketball safety apparatus in accordance with claim 6, wherein said ballast is sand.

8. A basketball safety apparatus in accordance with claim 6, wherein said ballast is water.

9. A basketball safety apparatus in accordance with claim 1, wherein said netting has mesh dimensions of at least two inches.

10. A basketball safety apparatus in accordance with claim 1, wherein said netting has a mesh dimension in at least one direction of approximately four and one half inches.

11. A basketball safety apparatus in accordance with claim 1, wherein said plurality of moveable pole support bases are comprised of at least three poles adapted to be positioned approximately twelve feet apart.

12. A basketball safety apparatus in accordance with claim 1, wherein said netting across said driveway has a length of approximately fourteen feet.

13. A basketball safety apparatus, comprising:

a basketball hoop mounted in proximity to a driveway which connects to a street;

a plurality of vertically mounted poles, each of said poles being mounted in a moveable base;

at least one additional pole vertically mounted in a moveable base;

said moveable bases being positioned in proximity to said basketball hoop and said driveway;

said poles being connected together by removable netting and arranged in proximity to said basketball hoop and said driveway such that said at least one additional pole causes said netting to form a barrier in two approximately orthogonal directions one of which forms a barrier across said driveway; and each of said poles being provided with a plurality of fasteners for connecting said removable netting to said poles.

14. A basketball safety apparatus in accordance with claim 13, wherein each of said vertically mounted poles is comprised of two pieces of approximately equal length pipe wherein said pieces may be readily joined for assembly.

15. A basketball safety apparatus in accordance with claim 14, wherein said two pieces of pipe are joined by a male/female connection.

16. A basketball safety apparatus in accordance with claim 14, wherein each of said pieces of pipe are approximately five and one half feet long.

17. A basketball safety apparatus in accordance with claim 13, wherein said vertically mounted poles are comprised of polyvinyl chloride (PVC) pipe.

18. A basketball safety apparatus in accordance with claim 13, wherein said moveable bases are comprised of containers adapted to receive one end of said pole, said containers being adapted to be filled with ballast.

19. A basketball safety apparatus in accordance with claim 18, wherein said ballast is sand.

20. A basketball safety apparatus in accordance with claim 18, wherein said ballast is water.

21. A basketball safety apparatus in accordance with claim 13, wherein said netting has mesh dimensions of at least two inches.

22. A basketball safety apparatus in accordance with claim 13, wherein said netting has a mesh dimension in at least one direction of approximately four and one half inches.

23. A basketball safety apparatus in accordance with claim 13, wherein said plurality of moveable pole support bases are comprised of at least three poles adapted to be positioned approximately twelve feet apart.

24. Apparatus in the form of a kit for assembling a basketball safety structure, comprising:

said kit to be assembled for use in connection with a basketball hoop mounted in proximity to a driveway which connects to a street;

at least four moveable pole support bases adapted to be positioned in proximity to said basketball hoop;

at least four poles adapted to be mounted vertically in said pole support bases;

at least three sections of netting adapted to be connected to said vertically mounted poles;

said poles and bases being adapted to be mounted and arranged so that three of said poles and two sections of said netting form a barrier in one direction from said basketball hoop and the third section of said netting and said fourth pole form a barrier in a second direction from the basketball hoop with at least one of said sections forming a barrier across said driveway; and said poles being approximately eleven feet high and said netting being at least ten feet high wherein it is unlikely for a basketball to bounce off of said basketball hoop and over said netting.

25. A basketball safety apparatus in accordance with claim 24, wherein each of said poles is comprised of two pieces of approximately equal length pipe wherein said pieces may be readily joined for assembly.

26. A basketball safety apparatus in accordance with claim 25, wherein said two pieces of pipe are joined by a male/female connection.

27. A basketball safety apparatus in accordance with claim 25, wherein each of said pieces of pipe is approximately five and half feet long.

28. A basketball safety apparatus in accordance with claim 24, wherein said poles are comprised of polyvinyl chloride (PVC) pipe.

29. A basketball safety apparatus in accordance with claim 24, wherein said pole support bases are comprised of containers adapted to receive one end of said pole, said containers being adapted to be filled with ballast.

30. A basketball safety apparatus in accordance with claim 29, wherein said ballast is sand.

31. A basketball safety apparatus in accordance with claim 29, wherein said ballast is water.

32. A basketball safety apparatus in accordance with claim 24, wherein said netting has mesh dimensions of at least two inches.

33. A basketball safety apparatus in accordance with claim 24, wherein said netting has a mesh dimension in at least one direction of approximately four and one half inches.

34. A basketball safety apparatus in accordance with claim 24, wherein said three of said poles are adapted to be positioned approximately twelve feet apart and connected to sections of netting approximately twelve feet long.

35. A basketball safety apparatus in accordance with claim 24, wherein said fourth pipe is connected to said third section of netting having a length of approximately fourteen feet.

36. A safety apparatus in accordance with claim 24 wherein said sections of netting are connected to said poles by resilient connectors.

37. A safety apparatus in accordance with claim 36 wherein said resilient connectors include springs.

38. A ball safety apparatus, comprising:

a plurality of vertically mounted poles, each of said poles being mounted in a moveable base;

at least one additional pole vertically mounted in a moveable base;

each of said moveable bases adapted to be positioned in proximity to a basketball hoop mounted near a driveway;

each of said poles being comprised of at least two mating components;

said poles being connected together by netting and arranged such that said at least one additional pole causes said netting to form a barrier in two substantially orthogonal directions, and across said driveway; and said poles being at least eleven feet high and said netting being at least ten feet high.

39. A ball safety apparatus in accordance with claim 38, wherein each of said vertically mounted poles is comprised of two pieces of approximately equal length pipe wherein said pieces may be readily joined for assembly.

40. A ball safety apparatus in accordance with claim 39, wherein said two pieces of pipe are joined by a male/female connection.

41. A ball safety apparatus in accordance with claim 39, wherein each of said pieces of pipe are approximately five and one half feet long.

42. A ball safety apparatus in accordance with claim 38, wherein said vertically mounted poles are comprised of polyvinyl chloride (PVC) pipe.

43. A ball safety apparatus in accordance with claim 38, wherein said moveable bases are comprised of containers adapted to receive one end of said pole, said containers being adapted to be filled with ballast.

44. A ball safety apparatus in accordance with claim 43, wherein said ballast is sand.

45. A ball safety apparatus in accordance with claim 41, wherein said ballast is water.

46. A ball safety apparatus in accordance with claim 38, wherein said netting has mesh dimensions of at least two inches.

47. A ball safety apparatus in accordance with claim 38, wherein said netting has a mesh dimension in at least one direction of approximately four and one half inches.

48. A ball safety apparatus in accordance with claim 38, wherein said plurality of moveable pole support bases are comprised of at least three poles adapted to be positioned approximately twelve feet apart.

* * * * *

UNITED STATES PATENT AND TRADEMARK OFFICE

CERTIFICATE OF CORRECTION

PATENT NO. : 5,402,999

DATED : April 4, 1995

INVENTOR(S) : Gorman E. Keehn, Sr.

It is certified that error appears in the above-identified patent and that said Letters Patent is hereby corrected as shown below:

Column 8, line 34, delete "41", insert --43--.

Signed and Sealed this

Thirteenth Day of June, 1995

Bruce Lehman

*Attest:*

BRUCE LEHMAN

*Attesting Officer*

*Commissioner of Patents and Trademarks*